United States Patent [19]

Menig

[11] 4,153,007

[45] May 8, 1979

[54] TAPER CANDLE FABRICATION APPARATUS

[76] Inventor: John B. Menig, 283 Hart La., Ben Lomond, Calif. 95005

[21] Appl. No.: 872,611

[22] Filed: Jan. 26, 1978

Related U.S. Application Data

[62] Division of Ser. No. 695,430, Jun. 14, 1976, Pat. No. 4,096,298.

[51] Int. Cl.[2] ..... B05C 5/00

[52] U.S. Cl. ..... 118/101; 118/316; 118/319

[58] Field of Search ..... 118/59, 101, 316, 319; 425/803

[56] References Cited

U.S. PATENT DOCUMENTS

| | | | |
|---|---|---|---|
| 2,732,319 | 1/1956 | Cree | 118/68 X |
| 3,385,649 | 5/1968 | Hicks | 431/126 |
| 3,809,570 | 5/1974 | Herman | 118/325 X |
| 3,847,111 | 11/1974 | Kreutzer | 118/2 |

*Primary Examiner*—John McIntosh
*Attorney, Agent, or Firm*—Flehr, Hohbach, Test, Albritton & Herbert

[57] ABSTRACT

A layered wax taper candle having a centrally disposed wick in which the wax and the layers is disposed in a streaked wood-grain like arrangement. Apparatus for fabricating the taper candles includes a rotating table driven in a horizontal plane by a driving motor. Wick holders are disposed in spaced relation near the periphery of the table so that they are driven in a rotary path to pass through a pouring station also located at the periphery of the table. Pouring spouts are located at the pouring station for directing a stream of liquid wax to flow therefrom. The stream of liquid wax has opposing lateral flow direction components therein. A combination recovery sump and liquid wax storage container is located below the pouring point to retrieve liquid wax emitting therefrom. A submerged pump is in the container to urge the liquid wax from the container through a conduit to the spouts at the pouring station. A heated platen is located adjacent to and below the pouring station for contacting the lower end of a plurality of wicks depending from the wick holders. Wax poured around the depending wicks at the pouring station surrounds the wicks in layered fashion each time the wicks pass through the liquid wax stream and the layers are defined in length on the wick by contact with the heated platen at the lower end thereof. Repeated passage into and out of the liquid wax stream and over the heated platen provides a layered wax taper having a defined length.

7 Claims, 6 Drawing Figures

TAPER CANDLE FABRICATION APPARATUS

This is a division of application Ser. No. 695,430 filed June 14, 1976, now U.S. Pat. No. 4,096,298.

BACKGROUND OF THE INVENTION

This invention relates to wax taper candles and more particularly to such candles fabricated quickly in layered formation by automatic fabrication apparatus.

Taper candle fabrication in the past has taken a form of stretching a wick through a candle mold and holding the wick centrally disposed in the mold cavity while pouring molten wax into the mold to surround the wick or by repeatedly dipping a candle wick into a vat of liquid wax and withdrawing the wick to allow successive layers of solidified wax to form thereon. The former method and apparatus produces a taper candle which is not optimum in burning qualities or appearance. The latter method and apparatus involved in forming taper candles is overly labor/time consuming and produces a relatively expensive candle article. Moreover, the dipping process requires taper candle length adjustment steps after taper formation. A method and apparatus for producing taper candle articles of attractive appearance is required which is efficient in the use of raw materials and fabrication machine time and labor resources.

SUMMARY AND OBJECTS OF THE INVENTION

A candle article is disclosed herein having a centrally disposed wick and a tapered wax body formed of a plurality of concentric wax layers in which the wax is disposed to provide a streaked or wood/grain like exterior for the candle. The apparatus utilized to fabricate the candle includes a wick support table having a structure thereon for retaining a plurality of depending wicks in spaced relation. Structure is provided for supporting the wick support table so that it may undergo a predetermined motion. A driving component is provided for moving the wick support table in a cyclic motion so that the depending wicks are moved through a pouring station which is adjacent to the wick support table in a cyclic manner. A container is provided for holding a quantity of liquid wax. A heater is mounted adjacent to the container for maintaining the wax therein in the liquid phase. Structure is provided for conducting a liquid wax from the container to the pouring station and means are coupled thereto for directing the liquid wax to flow therefrom to impinge near the tops of the depending wicks as they pass. The liquid wax flow thereafter runs toward the bottom of the wicks so that as the wicks depart from the pouring station a layer of wax solidifies therearound for each passage. Excess liquid wax is collected in the container which is positioned below the pouring station. In this fashion, a layered tapered mass of solidified wax collects on the depending wicks. The solidified wax mass is controlled in length by contacting the lower end thereof to heat the contacting wax to reassume the liquid phase and return to the container.

The method includes melting a mass of wax to assume a liquid state and hanging a candle wick from a supporting point. Thereafter, the liquid wax is caused to flow at a pour point to fall in a stream having opposing lateral flow direction components. The process includes moving the wick and the pour point into and out of coincidence so that liquid wax flows down the candle wick while surrounded by the liquid flow, adhering thereto due to surface tension, and a layer of wax solidifies around the wick after it departs from the liquid wax flow. The steps of recovering the liquid wax in the stream which does not solidify around the wick and of redirecting the recovered liquid wax back to the pour point is included in the process. A layered wax taper candle is provided as a result of a process which has a centrally disposed wick and a wood/grain appearing disposition of wax throughout the layers.

Another object of the present invention is to provide a fabrication apparatus which forms the attractive wax candle tapers utilizing less labor time.

Another object of the present invention is to provide a fabrication apparatus which conserves substantially all of the raw materials utilized in the fabrication.

Additional objects and features of the invention will appear from the following description in which the preferred embodiment has been set forth in detail in conjunction with the accompanying drawings.

DESCRIPTION OF THE PREFERRED EMBODIMENTS

Figure 1:
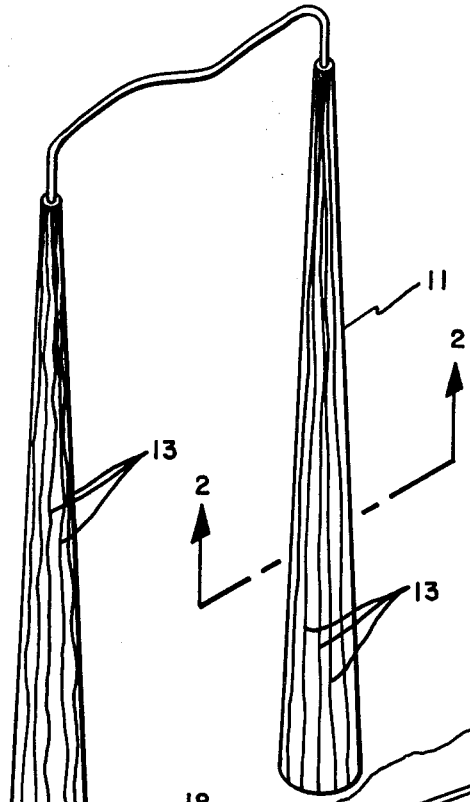
FIG. 1 is an isometric view of a pair of taper candles fabricated on the disclosed apparatus utilizing the disclosed method.
Figure 2:
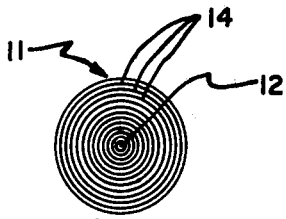
FIG. 2 is a sectional view along the line 2—2 of FIG. 1.

FIG. 1 shows a pair of wax taper candles 11 with their wicks 12 joined at the top. The candles are formed so that the wax is disposed to provide a random array of streaks 13 providing a wood/grain like appearance. The wood/grain like streaks 13 run throughout the wax in the body of the candle 11. FIG. 2 shows that the body of the candle 11 is formed of a series of concentric layers 14 formed about the wick 12 centrally disposed therein.

Figure 3:
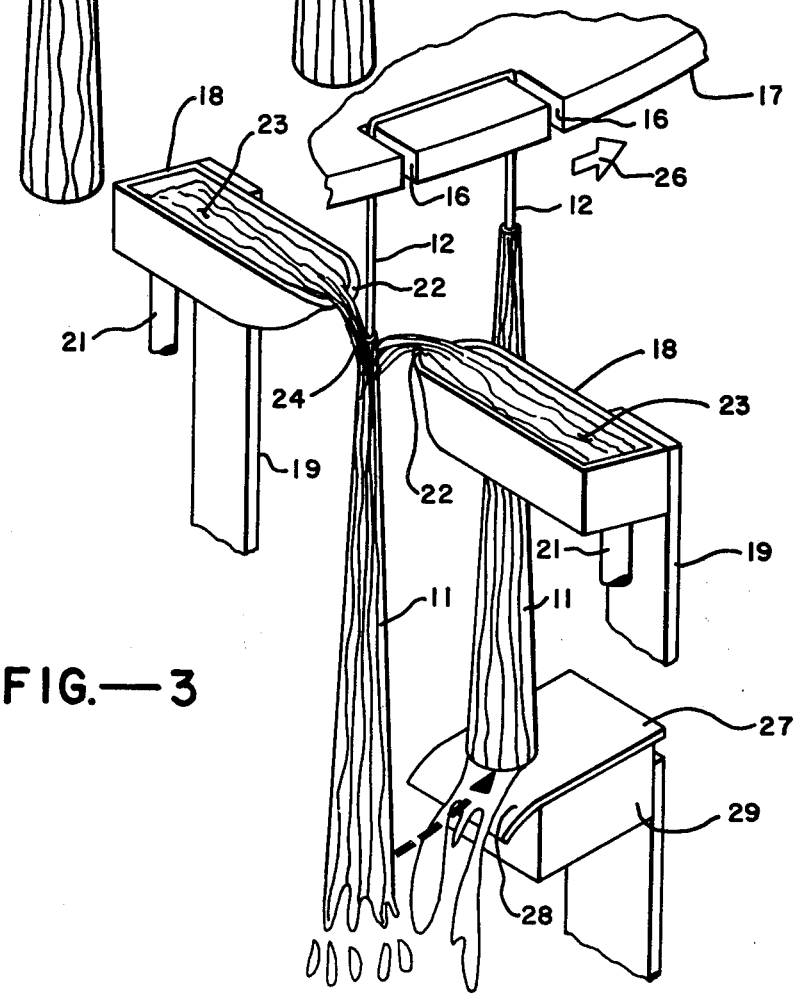
FIG. 3 is a partial isometric view of the disclosed apparatus.

FIG. 3 is a partial cut-away view of structure for implementing the process by which the taper candle 11 of FIGS. 1 and 2 is fabricated. The wick 12 is suspended from slots 16 in the edge of a wick support table 17, to depend therefrom as shown. A pair of pouring spouts 18 are shown supported by spout braces 19 and having input tubes 21 attached thereto. Pouring spouts 18 have pouring lips 22 and are configured to hold a quantity of melted wax 23 which is directed to pouring spouts 18 through input tubes 21. The melted or liquid phase wax 23 spills over pouring lips 22 when the pouring spouts 18 are sufficiently filled and joins in a single descending stream having opposite lateral flow components therein at a pouring point 24 located between and slightly below the pouring lips 22. Wick support table 17 is caused to move relative to pouring point 24 in the direction shown by arrow 26 so that depending wicks 12 pass thorugh pouring point 24 so that the liquid wax 23 impinges on the suspended wick 11 at pouring point 24 and flows down wick 11 due to surface tension. Excess wax 23 flows off of wick 11 as shown in 23 and after wick 11 has passed through pouring point 24 a retained layer of wax 23 solidifies around wick 11. As wick 11 and the solidifying layer of wax 23 moves in the direction of arrow 26, it is caused to pass over a heated platen 27 which contacts wick 11 and the layer of solidified wax therearound near the bottom thereof. Consequently, the solidifying wax at and below the point of contact with heated platen 27 is returned to the liquid state, running off of a ramp 28 on heated platen 27 as shown in FIG. 3. A heating element 29 may be provided for maintaining heated platen 27 at a temperature sufficiently high to quickly return the solidifying wax to the liquid phase.

Thus, cycling of the depending wicks 12 through the pouring point 24 and subsequent passing out of the stream of liquid wax 23, causes layers 14 of solidified wax to collect concentrically about wick 12. The cooling tendency of the liquid wax 23 as it descends from pouring point 24 causes the layers 14 to be thinner near the top of candle 11 and thicker toward the bottom, thereby providing the tapered shape for candles 11. Heating of the solidified wax mass at the lower end thereof defines one end of candle 11, and the total length is determined by the distance between pouring point 24 and the point of contact of the lower end of candle 11 with heated platen 27. Heated platen 27 is adjustable in a vertical direction to obtain a predetermined length for candle 11. The wax in liquid wax flow 23 which remains in liquid phase and drips off of the lower end of candle 11, as well as the wax returned to the liquid phase by heated platen 27 and flowing off of ramp 28 is returned to a reservoir for redirection to pouring spouts 18 as hereinafter described. It should be noted that the movement between wicks 12 and pouring point 24 is relative and that wicks 12 are directed therethrough in a cyclic fashion until a sufficient solidified wax mass collects thereon to provide the desired dimensions for candle 11. The flowing nature of the wax 23 as it passes down the body of candle 11 provides a disposition of color pigment in the wax and thickness in the wax layers 14, so that a wood/grain randomly streaked appearance of attractive nature is achieved.

Figure 4:
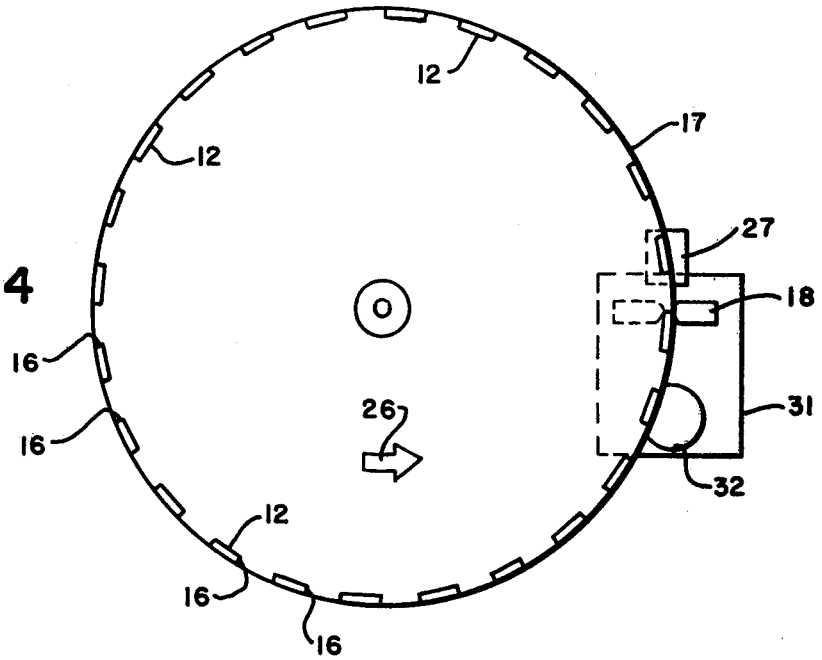
FIG. 4 is a plan view of the candle taper fabrication.
Figure 5:
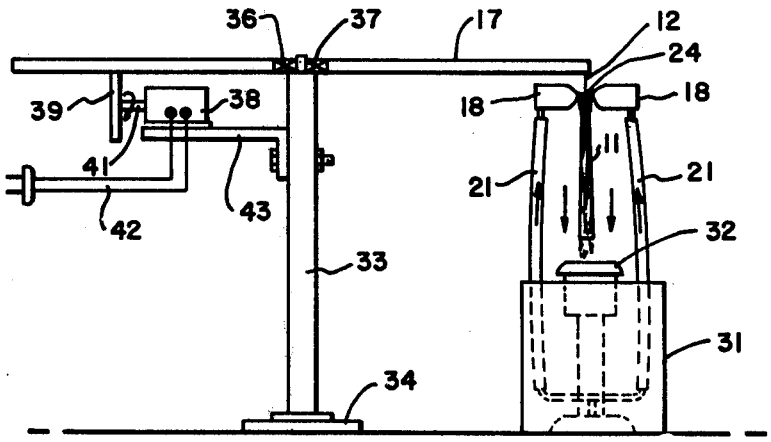
FIG. 5 is a side elevational view showing an embodiment of the candle taper fabrication apparatus.
Figure 6:
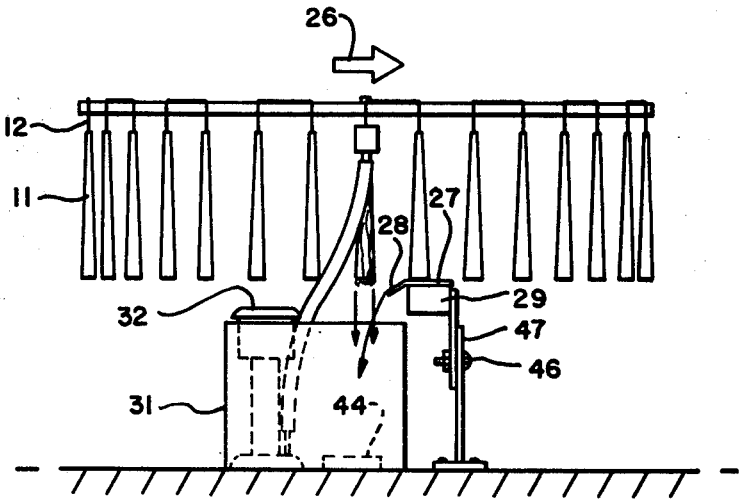
FIG. 6 is another side elevational view showing the candle taper fabrication apparatus in operation.

The manner in which the repeated passage of wicks 12 through pouring point 24 is achieved is illustrated in FIGS. 4 through 6. Rotary motion is described here for obtaining the cyclic delivery of wicks 12 to pour point 24, but it should be noted that rectilinear translation, as by link belt for example, could be utilized and is intended to be within the scope of the disclosed invention. Wick support table 17 is shown as a circular disc driven in the direction of arrow 26 and having a plurality of means for suspending wicks 12 at the periphery thereof. These last named means are shown as slots 16 for purposes of description, but could be any equivalent means, such as clips, etc. A container 31 is shown having a pump 32 associated therewith for urging liquid wax stored in container 31 through input tubes 21 to thereby deliver liquid wax 23 to pouring spouts 18 as described above.

FIG. 5 shows a base 33 in the form of a vertically disposed stanchion having a support base 34 at the bottom thereof and a shoulder 36 at the top thereof for receiving and supporting a bearing 37. Table 17 is mounted on the outer face of bearing 37 as shown, so that rotary motion may be imparted thereto. Means for driving table 17 in rotary motion are provided in the form of a motor 38 driving a contact wheel 39 through a shaft 41, so that a friction drive for table 17 is obtained. Motor 38 is powered through electrical leads 42 for coupling to an electrical power source (not shown). The locational speed of support table 17 may be adjusted by adjusting the radial position of driving wheel 39 through radially positioning motor 38 on a motor support arm 43. Alternate means for driving table 17 are envisioned, such a gear drive, etc.

Liquid phase wax 23 is recirculated by pump 32 as it falls from pour point 24 to be collected in wax container 31 positioned below pour point 24 in this embodiment. Thereafter the liquid phase was 23 is urged upwardly through input tubes 21 to pouring spouts 18 to overflow lips 22 as described above.

FIG. 6 shows a plurality of depending wicks 12 hanging from slots 16 in the periphery of support table 17. The wicks 12 and the collecting layered wax mass forming the body of candle 11 are shown being cyclicly passed by pouring point 24 for receiving a fresh bath of liquid wax 23 at each passage. Excess liquid wax 23 falls back into container 31 as disclosed above, where the contained volume of wax is kept in the liquid state by means of a heater 44. Heated platen 27 is shown positioned to contact the lower ends of the layered wax mass forming the body of tapered candle 11 just after passing through the liquid wax bath at pour point 24. Wax conatcting heated platen 27 is returned to the liquid phase and directed by ramp 28 to also return to container 31 for recirculation to pouring spouts 18 and pour point 24. Heated platen 27 is adjustable in vertical position by loosening a screw 46 which allows adjustment in length of the support arm 47 for heater element 29 in heated platen 27. In this fashion, candles 11 are set to have a predetermined length, while being formed, extending from pour point 24 to the lower end of the collecting layered wax mass which contacts heated platen 27.

The method for producing a wax taper candle 11 having a centrally disposed wick 12 and wax pigment disposition for providing a random wood/grain like or streaked appearance includes melting a mass of wax to a liquid state and flowing the liquid wax to fall from a pour point 24 in a stream having opposing lateral flow direction components. Thereafter hanging a candle wick 12 from a supporting structure and moving the wick 12 and the pour point 24 into and out of coincidence is accomplished whereby liquid wax flows downwardly on the wick 12 due to surface tension and after the wax wetted wick is removed from the liquid wax flow, a layer of wax solidifies around the wick 12. Repeated movement of the wick 12 into and out of coincidence with the pour point 24 provides a layered wax taper due to the thinner characteristic of the layers in the upper portions as compared with the lower portions due to the higher temperatures of the liquid wax in the upper reaches of the poured stream of wax. Thereafter, the method includes recovering the liquid wax which is not solidified and redirecting the the recovered liquid wax to the pour point to thereby provide a constant flow of liquid wax at the pour point 24. The collecting layered mass of wax concentrically disposed about a wick 12 is thereafter sized in length by maintaining the lower portion of the layered wax mass at a temperature sufficient to retain the wax in the liquid phase, whereby it runs off and defines the lower end of the solidified layered wax mass.

A novel layered taper candle with a wood/grain like pigmentation arrangement has been disclosed together with a method for forming the same and an apparatus by which the method may be practiced to produce the tapered candles.

What is claimed is:

1. Apparatus for fabricating a plurality of wax candles including a centrally located wick running therethrough, comprising a wick support table, means on said wick support table for retaining a plurality of depending wicks in spaced relation, means for supporting said wick support table permitting table motion thereon, driving means for moving said wick support table in cyclic motion, thereby cyclicly moving the depending wicks past a pouring station adjacent to said wick support table, a container, a heater mounted adjacent to said container for maintaining wax therein in a liquid phase, means for conducting liquid wax from said container to said pouring station, whereby liquid wax is poured on the depending wicks near the tops thereof as they pass said pouring station, to thereafter run toward the bottom of the depending wicks so that a layer of wax solidifies therearound each time one of the depending wicks passes said pouring station, excess liquid wax being thereafter directed to said container, whereby a layered tapered mass of solidified wax collects on the depending wicks, and means for controlling the length of the solidified wax.

2. Apparatus as in claim 1 wherein said means for conducting comprises a conduit and a pump for urging liquid wax through said conduit.

3. Apparatus as in claim 1 wherein said wick support table is circular and disposed in a horizontal plane, and said means for retaining comprises wick holders at the periphery of said wick support table, said means for supporting and providing table motion comprising a vertically disposed base and a bearing mounted at the top of said base contacting said support table at the center thereof, whereby said circular support table is driven rotationally on said bearing.

4. An apparatus for fabricating wax taper candles having centrally disposed wicks, comprising a base, a table mounted for rotational motion on said base, thereby having a center of rotation, a plurality of means on said table for retaining a plurality of candle wicks depending from said table, said last named plurality of means being located on a common radius from said center of rotation, said table operating to carry each of said plurality of means by a pouring station adjacent to said table each revolution of said table, a container for holding liquid phase wax, means for pouring at least two streams of liquid phase wax having opposing flow direction components at said pouring station, so that liquid wax impinges around the circumference of ones of the depending candle wicks at said pouring station, means extending between said container and said means for pouring, operating to move liquid phase wax to said means for pouring, means for driving said table rotationally, whereby successive layers of wax solidify overlying each candle wick, said container being located below said pouring station whereby liquid phase wax is returned from said pouring station to said container by gravity, and a heated platen located adjacent to said pour station positioned to contact the lower ends of the plurality of candle wicks, thereby defining the length of the solidified layers of wax.

5. An apparatus as in claim 4 wherein said means extending between said container and said means for pouring comprises a submerged pump in said container, and a tube between said pump and said means for pouring.

6. An apparatus as in claim 4 wherein said means for pouring comprises opposing spouts radially directed at said pouring station from opposite sides thereof.

7. An apparatus as in claim 4 wherein said heated platen is adjustable in height, whereby the wax taper candles are formed having a predetermined length.

* * * * *